US009924767B2

(12) United States Patent
Seitz

(10) Patent No.: US 9,924,767 B2
(45) Date of Patent: Mar. 27, 2018

(54) ILLUMINATED WEARABLE DEVICE

(71) Applicant: Ian Keith Seitz, Renton, WA (US)

(72) Inventor: Ian Keith Seitz, Renton, WA (US)

(73) Assignee: SeaStar Global, Renton, WA (US)

( * ) Notice: Subject to any disclaimer, the term of this patent is extended or adjusted under 35 U.S.C. 154(b) by 0 days.

(21) Appl. No.: 14/990,801

(22) Filed: Jan. 8, 2016

(65) Prior Publication Data

US 2017/0196317 A1 Jul. 13, 2017

(51) Int. Cl.

| | |
|---|---|
| ***F21V 21/08*** | (2006.01) |
| ***A44C 15/00*** | (2006.01) |
| ***F21V 23/04*** | (2006.01) |
| ***F21V 21/088*** | (2006.01) |
| ***F21L 4/00*** | (2006.01) |
| ***F21V 23/00*** | (2015.01) |
| ***F21V 33/00*** | (2006.01) |
| ***A44C 1/00*** | (2006.01) |
| *F21Y 115/10* | (2016.01) |
| *F21W 121/06* | (2006.01) |

(52) U.S. Cl.

CPC ..... *A44C 15/0015* (2013.01); *A44C 1/00* (2013.01); *F21L 4/00* (2013.01); *F21V 21/0885* (2013.01); *F21V 23/002* (2013.01); *F21V 23/0407* (2013.01); *F21V 33/0008* (2013.01); *F21W 2121/06* (2013.01); *F21Y 2115/10* (2016.08)

(58) Field of Classification Search

CPC ..... A44C 1/00; A44C 15/0015; F21L 4/00; F21V 21/0885; F21V 23/002; F21V 23/0407; F21V 33/0008; F21W 2121/06

USPC ..... 362/103–104

See application file for complete search history.

(56) References Cited

U.S. PATENT DOCUMENTS

| | | | | |
|---|---|---|---|---|
| 4,076,976 A * | 2/1978 | Fenton | A44C 15/0015 | 362/104 |
| 4,459,645 A * | 7/1984 | Glatter | A44C 15/0015 | 174/50.55 |
| 5,951,158 A * | 9/1999 | Upah | G02B 6/0008 | 362/104 |
| 8,789,965 B2 * | 7/2014 | Rapisarda | A43B 3/001 | 362/103 |

* cited by examiner

*Primary Examiner* — Jason Moon Han

(74) *Attorney, Agent, or Firm* — Elizabeth Zehr

(57) ABSTRACT

Embodiments of an illuminated wearable device such as a lapel pin are disclosed. A light emitting source such as a light emitting diode is attached to an ornamental element. A detachable clutch containing a power source attaches to a prong extruding from a back side of the ornamental element to advantageously hold the ornamental element in place while conductively connecting the light emitting source to the power source.

20 Claims, 2 Drawing Sheets

ILLUMINATED WEARABLE DEVICE

TECHNICAL FIELD

The present disclosure pertains to illuminated wearable devices such as an illuminated lapel pin.

BACKGROUND

Wearable devices such as lapel pins or other jewelry may be used for various purposes such as for fashion purposes, as symbols of achievement or belonging, as collectible items, or to indicate affiliation with a certain organization or cause. In some instances, it is desirable to further adorn such wearable devices via illumination elements. For example, a light such as a light emitting diode may be molded into a lapel pin to illuminate the pin when it is worn.

Traditional illuminated wearable devices have historically been disadvantageous for various reasons. In some instances, traditional illuminated wearable devices are cumbersome to wear because they require a variety of screws or clamps or other fastening elements to secure the device to the user. Often times these parts are easily lost or broken rendering the device inoperable.

In other instances, traditional illuminated wearable devices are overly bulky. For example, some traditional illuminated wearable devices require the user to carry an external battery pack on their person or in their pocket in order to power the device. Often times these external battery packs are heavy and inconvenient to lug around. Additionally, such traditional illuminated wearable devices may also include long wires that run from the battery to the device which requires the user to take additional measures to conspicuously hide these electronic elements. Furthermore, these traditional illuminated wearable devices may have shorter life spans because there no convenient way to replace or recharge the batteries.

In many instances, the cumbersome electronic elements of the traditional illuminated wearable devices take away from the design of the device rather than enhancing it. For example, batteries, wires, and backing plates undesirably stick out from the device. Consequently, the overall ornamental elements of the traditional illuminated wearable devices are depreciated.

Due to one or more of these disadvantage, further improvements to traditional illuminated wearable devices are desirable.

SUMMARY

Illustrative embodiments of an improved illuminated wearable device such as a lapel pin are disclosed. A light emitting source such as a light emitting diode is attached to an ornamental element. A detachable clutch attaches to a prong extending from a back side of the ornamental element to hold the illuminated wearable device in place. The detachable clutch includes a power source such that when the detachable clutch is attached to the prong it completes an electrical circuit to illuminate the light emitting source. As such, the detachable clutch advantageously provides multiple functions to the illuminated wearable device. First, it holds the ornamental element in place. Second, it conductively connects the light emitting source to the power source.

In some instances, the power source is advantageously concealed behind the ornamental element such that it is inconspicuous to anyone observing the illuminated wearable device. For example, the power source and prong may be positioned co-axially behind the light emitting source such that it is hidden from view behind the ornamental element.

In some embodiments, the illuminated wearable device may further include an attachment piece that extends from the back side of the ornamental element and a clasp element that detachably attaches to the attachment piece to further hold the illuminated wearable device in place.

The features, functions, and advantages of the illuminated wearable device may be independently achievable in various embodiments of the present disclosure or combinable in yet other embodiments.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Overview

As discussed above, although illuminated wearable devices advantageously adorn non-illuminated wearable devices, further improvements are desirable. Techniques for further improving illuminated wearable devices are disclosed herein. Some techniques include embedding portions of the electronic elements into functional elements of the wearable device. Other techniques involve reducing the quantity and size of the batteries required to power the wearable device. In addition, electronic elements such as the batteries and wires are positioned behind the ornamental elements of the device such that they are hidden from view and thus do not detract from the ornamental design.

As discussed herein, the techniques may be implemented on any wearable device including without limitation jewelry, earrings, cufflinks, or pins.

Illustrative Device

Figure 1A:
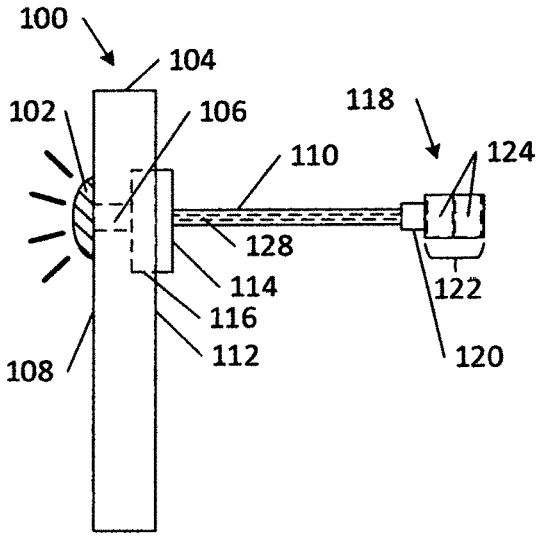
FIG. 1A is a side view of an illustrative embodiment of an illuminated wearable device.
Figure 1B:
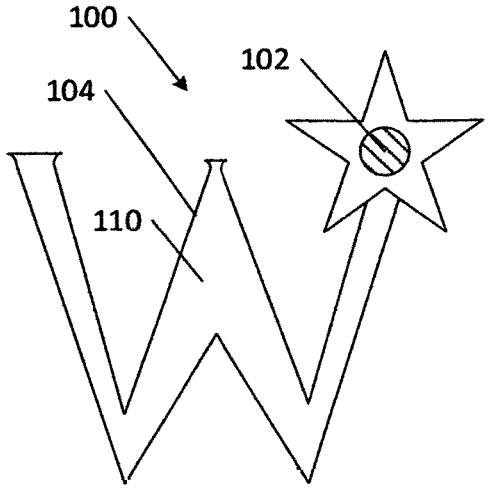
FIG. 1B is a front view of the illustrative embodiment of an illuminated wearable device.

FIG. 1A and FIG. 1B are an illustrative embodiment of an illuminated wearable device 100. FIG. 1A is a side view of the illustrative illuminated wearable device 100 and FIG. 1B is a front view of the illustrative illuminated wearable device 100. In one embodiment, the illuminated wearable device 100 is an illuminated ornamental lapel pin. In an alternative embodiment, the illuminated wearable device 100 may be a piece of jewelry such as an earring, cufflink, or pin.

In the illustrative embodiment of the illuminated wearable device 100, a light emitting source 102 is attached to an ornamental element 104. In some instances, a pilot hole 106 may be positioned through the ornamental element 104 to aid in the placement and/or securement of the light emitting source 102. The pilot hole 106 may be co-axially positioned with the light emitting source 102 or alternatively, the pilot hole 106 may be off-center from the light emitting source 102. The ornamental element 104 may be of any metallic or non-metallic material. In some instances, the ornamental element 104 may be at least partially of a nickel material.

In some instances, the light emitting source 102 may stick out from a front side 108 of the ornamental element 104 as shown in FIG. 1A. Alternatively, the light emitting source 102 may be flush with a front side 108 of the ornamental element 104, completely embedded within the ornamental element 104, or attached to the ornamental element 104 in any other fashion.

As further illustrated in FIG. 1A, a prong 110 extends from a back side 112 of the ornamental element 104. In some instances, the prong 110 may include a base plate 114 to aid in securing the prong 110 to the back side 112 of the ornamental element 104. In some instances, the base plate 114 is positioned at least partially within a countersink hole 116 of the ornamental element 104. Alternatively, the base plate 114 may be attached adjacent to the back side 112 of the ornamental element 104. The prong 110 may attach to the base plate 114 by any method such as molding, soldering, screwing, tight fitting, and/or gluing.

In some instances, the prong 110 may be perpendicular to the back side 112 of the ornamental element 104 as illustrated in FIG. 1A, or alternatively, the prong 110 may be positioned at any angle from the back side 112 of the ornamental element 104. In some instances, the prong 110 may be co-axially positioned with the light emitting source 102.

As further illustrated in FIG. 1A, the illuminated wearable device 100 includes a detachable clutch 118. At least a portion of the prong 110 is inserted into a receiving end 120 of the detachable clutch 118 to secure the detachable clutch to the prong. The detachable clutch 118 includes a battery pack 122 that holds a power source 124 operable to provide power to the light emitting source 102.

In some instances, the power source 124 may consist of a single power storage element such as an individual battery to provide power to the light emitting source 102. Alternatively, the power source 124 may consist of more than one power storage element such as multiple batteries to provide power to the light emitting source 102. In some instances, the power source 124 consists of two Alkaline batteries of type LR521/Energizer 379.

In some instances, the power source 124 is removable from the battery pack 122 so that an operator of the illuminated wearable device 100 is able to replace the power source 124 as needed. In some instances, the detachable clutch 118 may be co-axially positioned with one or more of the prong 110, pilot hole 106, and light emitting source 102. Similarly, the power source 124 may be co-axially positioned with one or more of the detachable clutch 118, prong 110, pilot hole 106, and light emitting source 102.

In the illustrative embodiment of the illuminated wearable device 100, the detachable clutch 118 attaches to the prong 110 to hold the ornamental element 104 in place. For example, a wearer of the illuminated wearable device 100 may attach the illuminated wearable device 100 to their shirt by removing the detachable clutch 118, inserting the prong 110 through their shirt, and re-attaching the detachable clutch to the prong 110 on the inside of the shirt. In such instance, the prong 110 and detachable clutch 118 hold the ornamental element 104 in place on the wearer's shirt.

In the illustrative embodiment of the illuminated wearable device 100, the detachable clutch 118 also attaches to the prong 110 to conductively connect the power source 124 to the light emitting source 102. For example, when the prong 110 is inserted into the receiving end 120 of the detachable clutch 118, an electrical circuit is established to provide power to the light emitting source 102. In some instances, the detachable clutch 118 may simultaneously hold the ornamental element 104 in place while conductively connecting the light emitting source 102 to the power source 124.

In some instances, a wire 128 may run through the prong 110. For example, the wire 128 may attach to the light emitting source 102 at one end and the power source 124 at the other end when the detachable clutch 118 is attached to the prong 110. Alternatively, the detachable clutch 118 may provide power to the light emitting source 102 by other means. For example, the prong 110 may not include a wire but rather act as a conductor itself using alternative means to illuminate the light emitting source 102.

In some instances, the light emitting source 102 is illuminated when the prong 110 is inserted into the receiving end 120 of the detachable clutch 118. In such instances, there is no switch or button that a user needs to flip to illuminate the light emitting source 102. Alternatively, the illuminated wearable device 100 may further include an activation element to illuminate the light emitting source 102 after the prong 110 is inserted into the receiving end 120 of the detachable clutch 118.

Once illuminated, the light emitting source 102 may emit any color or intensity of light. In some instances, the light emitting source 102 may emit a solid or constant light. Alternatively, the light emitting source 102 may emit a blinking light. The detachable clutch 118 is further described in FIG. 3 below.

FIG. 1B is a front view of the exemplary illuminated wearable device 100. The front view of the exemplary illuminated wearable device 100 includes the light emitting source 102, the ornamental element 104, and the front side 108 of the ornamental element. In the illustrative embodiment of the illuminated wearable device 100, the wire 128 and power source 124 are hidden from view behind the ornamental element 104 as illustrated in FIG. 1B. In some instances, the power source 124 and prong 110 are co-axially positioned behind the light emitting source 102 to position the power source 124 in hidden view behind the ornamental element 104.

Figure 2A:
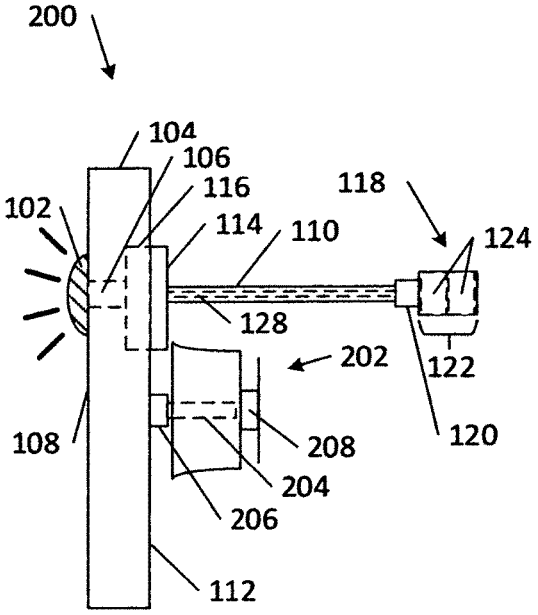
FIG. 2A is a side view of an alternative illustrative embodiment of an illuminated wearable device.
Figure 2B:
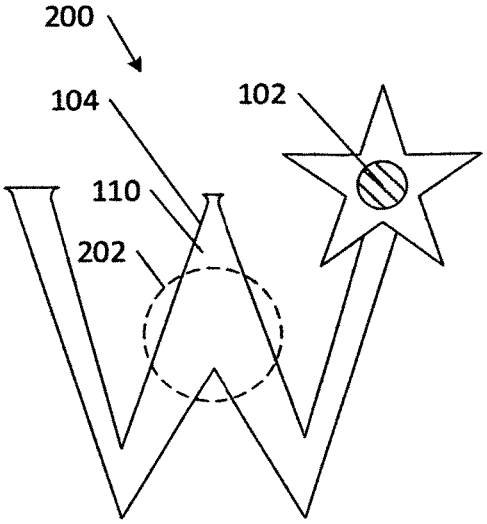
FIG. 2B is a front view of the alternative illustrative embodiment of an illuminated wearable device.

FIG. 2A and FIG. 2B are an alternative illustrative embodiment of an illuminated wearable device 200. FIG. 2A is a side view of the illustrative illuminated wearable device 200 and FIG. 2B is a front view of the illustrative illuminated wearable device 200. In one embodiment, the illuminated wearable device 200 is an illuminated ornamental lapel pin. In an alternative embodiment, the illuminated wearable device 200 may be a piece of jewelry such as an earring, cufflink, or pin.

In addition to the elements of the illustrative embodiment of the illuminated wearable device 100, the alternative illustrative embodiment of the illuminated wearable device 200 additionally includes a secondary attachment element 202. The secondary attachment element 202 consists of an attachment piece 204 that extends from the back side 112 of the ornamental element 100 and a clasp element 208 that removably attaches to the attachment piece 204 to further hold the illuminated wearable device 200 in place. In some instances, the attachment piece 204 may include an attachment piece plate 206 to aid in securing the attachment piece 204 to the back side 112 of the ornamental element 104. The attachment piece 204 may attach to the attachment piece plate 206 by any method such as molding, soldering, screwing, tight fitting, and/or gluing.

In some instances, the secondary attachment element 202 may be of a device known in the art such as a butterfly clutch, a jewelry clutch, a safety clasp, a magnetic clasp, a screw and nut clasp, or a stick pin. For example, the secondary attachment element 202 may be a butterfly clutch such that squeezing the clasp element 208 and pulling it away from the attachment piece 204 releases the clasp element 208 from the attachment piece 204.

FIG. 2B is a front view of the alternative illustrative embodiment of the illuminated wearable device 200. The front view of the illuminated wearable device 200 includes the light emitting source 102, the ornamental element 104, and the front side 108 of the ornamental element. In some instances, the front view of the illuminated wearable device 200 may additionally include at least a portion of the secondary attachment element 202. In some instances, the secondary attachment element 202 is hidden from view behind the ornamental element 104 when the illuminated wearable device 200 is worn by a user.

In the alternative illustrative embodiment of the illuminated wearable device 200, the illuminated wearable device is held in place by both the secondary attachment element 202 as well as by inserting the prong 110 into the receiving end 120 of the detachable clutch 118.

One advantage of both the illustrative embodiment of the illuminated wearable device 100 and the alternative illustrative embodiment of the illuminated wearable device 200 is that the wire 128 and power source 124 remain hidden from view behind the ornamental element 104 and as such do not detract from the design of the ornamental element 104. Rather, these elements (i.e., wire 128 and power source 124) are concealed behind the ornamental element 104 such that they are inconspicuous to anyone observing the ornamental element 104. In some instances, the wire 128 and power source 124 may both be co-axially positioned behind the light emitting source 102 such that they are hidden from view behind the light emitting source 102.

Figure 3:
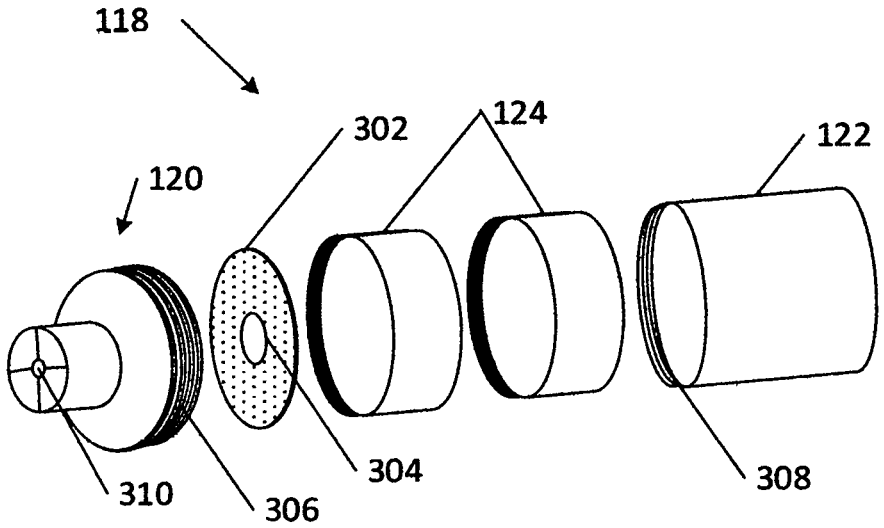
FIG. 3 is an exploded view of a detachable clutch.

FIG. 3 is an exploded view of the detachable clutch 118. At one end, the battery pack 122 contains the power source 124. In some instances, the power source 124 may consist of two batteries placed positive end first into the battery pack 112. The detachable clutch 118 may additionally include a washer 302 that is inserted into the battery back 122 after the power source 124 is positioned into the battery pack. In some instances, the washer may be of a non-conductive material such as a rubber or plastic material and may include a washer hole 304.

The detachable clutch 118 additionally includes the receiving end 120 to secure the power source 124 in the battery pack 122. In some instances, the receiving end 120 may secure both the power source 124 and the washer 302 in the battery pack 122. In some instances, the receiving end 120 may include a male thread 306 and the battery pack may include a female thread 308 such that the receiving end screws into the battery pack 112 to securely hold the power source 124 in place. Alternatively, the receiving end 120 may attach to the battery pack 112 by other means.

As further depicted in FIG. 3, the receiving end 120 additionally includes an aperture 310 for receiving the prong 110. For example, when the detachable clutch 118 attaches to the prong 110, at least a portion of the prong is positioned through the aperture 310 and rests against the power source 124. In some instances, at least a portion of the prong is positioned through the aperture 310 and through the hole 304 before resting against the power source 124.

As discussed above, in some instances the wire 128 is at least partially contained within the prong 110. In such instances, when the detachable clutch 118 attaches to the prong 110, at least a portion of the wire 128 extending from the prong is positioned through the aperture 310 and rests against the power source 124. In some instances, at least a portion of the wire 128 extending from the prong is positioned through the aperture 310 and through the hole 304 before resting against the power source 124.

CONCLUSION

While embodiments of the disclosure have been illustrated and described, as noted above, changes may be made without departing from the spirit and scope of the disclosure. Accordingly, the scope of the disclosure is not limited by the disclosure of these embodiments. Instead, the disclosure should be determined entirely by reference to the claims that follow.

What is claimed is:

1. An illuminated wearable device, comprising:
an ornamental element;
a light emitting source;
a non-detachable prong extending from a back side of the ornamental element;
a wire running through the non-detachable prong, the wire conductively connecting permanently to the light emitting source;
a detachable clutch, the detachable clutch removeably attachable to the prong to hold the illuminated wearable device in place while conductively connecting the light emitting source to a power source via the wire;
an attachment piece extending from the back side of the ornamental element; and
a clasp element detachably attachable to the attachment piece to further hold the illuminated wearable device in place.

2. The illuminated wearable device of claim 1, wherein the ornamental element includes a pilot hole drilled through the ornamental element to aid in securing the light emitting source to the ornamental element.

3. The illuminated wearable device of claim 1, wherein the power source is co-axially positioned with the prong.

4. The illuminated wearable device of claim 1, wherein the power source is co-axially positioned with the prong and the light emitting source.

5. The illuminated wearable device of claim 1, wherein the light emitting source is a light emitting diode.

6. The illuminated wearable device of claim 5, wherein the light emitting diode emits a solid or a blinking light.

7. The illuminated wearable device of claim 5, wherein the light emitting diode emits a colored light.

8. The illuminated wearable device of claim 1, wherein the prong, detachable clutch, and power source are positioned in hidden view behind the ornamental element when viewed from a front side of the illuminated wearable device.

9. An illuminated ornamental lapel pin, comprising:
an ornamental element;
a light emitting source;
a prong extending perpendicular from a back side of the ornamental element;
a detachable clutch having a battery pack embodied within, the detachable clutch to attach to the prong to hold the illuminated ornamental lapel pin in place;
a wire element irremovably connected at one end to the light emitting source and running through at least a portion of the prong to conductively connect the light emitting source to the battery pack when the detachable clutch is attached to the prong;
an attachment piece extending from the back side of the ornamental element; and a clasp element detachably attachable to the attachment piece to further hold the illuminated ornamental lapel pin in place.

10. The illuminated ornamental lapel pin of claim 9, wherein the prong, detachable clutch, and battery pack are all co-axially positioned behind the light emitting source.

11. The illuminated ornamental lapel pin of claim 9, wherein the light emitting source is a light emitting diode.

12. The illuminated ornamental lapel pin of claim 9, wherein the battery pack contains one or more removable batteries.

13. The illuminated ornamental lapel pin of claim 9, wherein the prong, detachable clutch, and battery pack are positioned in hidden view behind the ornamental element when viewed from a front side of the ornamental element.

14. The illuminated wearable device of claim 11, wherein the light emitting diode emits a solid or a blinking light.

15. The illuminated ornamental lapel pin of claim 9, wherein the ornamental element is in the shape of a "W".

16. An illuminated ornamental lapel pin, comprising:

an ornamental element having a front side and further having a back side;

a pilot hole positioned within at least a portion of the front side of the ornamental element;

a countersink hole positioned within at least a portion of the back side of the ornamental element, wherein the pilot hole is adjacent to the countersink hole;

a light emitting source positioned at least partially within the pilot hole;

a base plate positioned within at least a portion of the countersink hole;

a prong irremovably connected to the base plate, the prong extending from the back side of the ornamental element; and a wire element permanently running from the light emitting source through the pilot hole, through the countersink hole, and further through the prong to conductively connect the light emitting source to a power source contained within a detachable clutch.

17. The illuminated wearable device of claim 16, wherein the light emitting source is a light emitting diode.

18. The illuminated wearable device of claim 16, wherein the power source consists of one or more batteries removably contained within the detachable clutch.

19. The illuminated wearable device of claim 18, wherein the one or more batteries are Alkaline batteries.

20. The illuminated wearable device of claim 16, further including:

an attachment piece extending from the back side of the ornamental element; and a clasp element detachably attachable to the attachment piece to further hold the illuminated ornamental lapel pin in place.

* * * * *